US005581147A

United States Patent [19]

Koh et al.

[11] Patent Number: 5,581,147

[45] Date of Patent: Dec. 3, 1996

[54] ELECTRON GUN BODY FOR A COLOR CATHODE RAY TUBE

[75] Inventors: Nam J. Koh; Jin Y. Choi, both of Kyungsangbuk-do, Rep. of Korea

[73] Assignee: Goldstar Co., Ltd., Seoul, Rep. of Korea

[21] Appl. No.: 359,736

[22] Filed: Dec. 20, 1994

[51] Int. Cl.[6] ..... H01J 29/62

[52] U.S. Cl. ..... 313/414; 313/412; 313/409; 313/449

[58] Field of Search ..... 313/409, 412, 313/414, 416, 449

[56] References Cited

U.S. PATENT DOCUMENTS

| | | | |
|---|---|---|---|
| 4,542,318 | 9/1985 | Say | 313/414 |
| 4,599,534 | 7/1986 | Shirai et al. | 313/414 |
| 5,023,508 | 6/1991 | Park | 313/449 |
| 5,146,133 | 9/1992 | Shirai et al. | 313/414 |
| 5,196,762 | 3/1993 | Go | 313/414 |

*Primary Examiner*—Nimeshkumar Patel
*Attorney, Agent, or Firm*—Fish & Richardson P.C.

[57] ABSTRACT

An electron gun body for a color cathode ray tube includes an electron beam forming region formed by cathodes, first and second grids, and a main focusing lens having first and second accelerating and focusing electrodes for substantially focusing three electron beams from the electron beam forming region. The first and second accelerating and focusing electrodes are provided with through holes for passing the three electron beams and upper rims respectively bent from the outer circumferences of the electrodes toward the through holes, in which a first inclined extension electrode having a vertically-provided sloped portion and bottom portion, and a center hole opened to reach a bent plane of the sloped portion in the bottom portion is installed into the first accelerating and focusing electrode to fix one side of the first inclined extension electrode to connect with an inwardly-bent portion of the one upper rim, and a second inclined extension electrode having projections parallel in both directions on the same plane of a head portion is installed into the second accelerating and focusing electrode, while forming the vertical inner diameter of the projection to be smaller than that of the upper rim, to fix one side of the second inclined extension electrode to connect with an inwardly-bent portion of the other upper rim. Thus, astigmatism is eliminated without using a separate correction electrode to improve resolution on the periphery of a screen.

4 Claims, 6 Drawing Sheets

ELECTRON GUN BODY FOR A COLOR CATHODE RAY TUBE

BACKGROUND OF THE INVENTION

1. Field of the Invention

The present invention relates to an electron gun body for a color cathode ray tube (hereinafter simply referred to as "CCRT"), and more particularly to an electron gun body for a CCRT capable of improving resolution on the periphery of a screen by eliminating astigmatism without using a separate correction electrode.

2. Description of the Prior Art

In a conventional electron gun generally formed as shown in FIG. 1, a beam forming region is provided by cathodes 1 heated by a heater H for ejecting thermoelectrons in accordance with R, G and B electrical signals, a first grid 2 installed to one side of the cathodes 1 for controlling the electron beams from the cathodes 1, and a second grid electrode 3 installed to one side of the first grid 2 for attracting to accelerate the thermoelectrons gathered around the cathodes 1. Also, a first accelerating and focusing electrode 5 and a second accelerating and focusing electrode 6, which are fixed to a third grid 4 to form a main focusing lens for focusing successively-incoming electron beams from the beam forming region, are arranged in in-line type on one side of the second grid 3.

Additionally, a shield electrode (not shown) is fixed to the second accelerating and focusing electrode 6 for blocking to weaken a leakage magnetic field of a deflection yoke.

In connection with the kinds of electron guns, a third grid and a fourth grid for primarily focusing are additionally inserted between the electron beam forming region and the electrodes constituting the main focusing lens to form a preceding focusing lens system, thereby allowing the electron guns to have a multi-focusing type capability that reinforces the focusing effect.

All the above-mentioned electrodes respectively having three electron beam passing holes for permitting the RGB electron beams formed in the cathodes 1 to be passed are welded to be integrally constructed by a pair of bead glasses 7, being distant from one another.

In the conventional electron gun formed as above, once the cathodes 1 are heated by the heater H to eject the thermoelectrons, the electron beams are controlled in the first grid 2 and, simultaneously, are accelerated by the second grid 3 to be narrowly focused and accelerated while passing through the first accelerating and focusing electrode 5 and the second accelerating and focusing electrode 6 which form the main lens system, because of a voltage difference between the electrodes 5 and 6. Successively, the phosphors coated on the inner surface of a panel are excited to be luminous to produce an image on a screen.

The conventional electron gun has the electron beam passing holes perforated in the shape of nearly right circles sequentially from the first grid 2 to the second accelerating and focusing electrode 6, so that the main focusing lens formed by the first and second accelerating and focusing electrodes 5 and 6 becomes an axially-symmetrical circular lens. Therefore, the electron beams passing through the electron beam passing holes are symmetrically focused in conformity with the Lagrange's reflection law when a voltage required for operating the electron gun is supplied to respective electrodes. Then, the circular electron beams when emitted from the electron gun are focused when reaching the center of the screen unaffected by the deflection yoke to form reduced circular electron beam spots.

In other words, the electron beams from the electron gun scan the overall screen by a deflection magnetic field due to the deflection yoke to reproduce the image.

The deflection magnetic field by the deflection yoke deflects the electron beams to fill in the screen and, at the same time, converges the plurality of electron beams to prescribed spots of the screen in the CCRT that ejects the plurality of electron beams. For executing this function, a self convergence system is adopted, in which the electron beams are emitted in the horizontal in-line direction as described above, and the deflection magnetic field generated by the deflection yoke is forced to be an uneven magnetic field having different magnetic field strengths in the center and the periphery (the periphery of the screen).

By means of the magnetic field of the self convergence system, the RGB electron beams automatically converge on the overall screen.

Such a self convergence magnetic field is classified into a pincushion magnetic field being a horizontal deflection magnetic field, and a barrel magnetic field being a vertical deflection magnetic field.

These magnetic fields are respectively constituted by bipolar and quadrupolar components to mainly deflect by the bipolar component after being emitted from the electron gun and to be minutely subjected to the magnetic force by the quadrupolar component, thereby being affected by a diffusion magnetic field lens in the horizontal direction and a focusing magnetic field lens in the vertical direction.

Accordingly, as shown in FIG. 5, almost the same focusing operation both in the vertical and horizontal directions is carried out at the center of the screen unaffected by the deflection magnetic field. Thus, the electron beams form the substantially circular electron beam spots.

However, in the periphery of the screen affected by the deflection magnetic field, the electron beam of the vertical section is intensely focused by the focusing magnetic lens in the vertical direction to be over-focused, and the electron beam in the horizontal direction is diverged by the diffusion magnetic lens in the horizontal direction to be under-focused, thereby inducing a halo phenomenon to degrade resolution.

For this reason, in order to improve the degraded resolution around the periphery of the screen deteriorated by the deflection magnetic field, a technique shown in FIGS. 2 to 4 (which is disclosed in Korean Patent No. 17874) has been proposed.

Here, through holes 8 and 9 are formed in the opposing planes of the first and second accelerating and focusing electrodes 5 and 6 to allow three electron beams to commonly pass them. Upper rims 10 and 11 respectively bent from the outer circumferences toward the through holes 8 and 9 of the first and second accelerating and focusing electrodes 5 and 6 are provided. An inclined extension electrode 12 as shown in FIG. 4 is fixed to the inner portion of the through holes 8 and 9, maintaining a predetermined distance.

The inclined extension electrode 12 is formed by a head portion 13 to be fixed into the first and second accelerating and focusing electrodes 5 and 6, a sloped portion 14 having triangular projections **14*a* on the upper and lower portions thereof, and a bottom portion 15 having a center hole 15*a* extending to the sloped portion 14. Here, an inclination angle between the sloped portion 14 and the bottom portion 15** ranges from 100° to 140°.

The reason of setting the inclination angle from the head portion 13 to the bottom portion 15 from 100° to 140° is in that the beam spot is the smallest within the above range.

Also, the reason of extending the center hole 15*a* formed in the inclined extension electrode 12 to the sloped portion 14 is in that the spherical aberration is caused to be decreased to thus minimize the beam spot size.

Briefly, the magnetic field is forced to be consistently formed.

According to the electron gun adopting the inclined extension electrode 12, when the dimensions of the inclined extension electrode satisfy the static convergence, i.e., when the side beam and central beam coincide in the center of the screen, the electric field of the side hole becomes asymmetric in the horizontal and vertical directions due to the projection 14*a* of the sloped portion 14. Consequently, since astigmatism becomes greater in the side hole, the astigmatism which is a focusing difference in the horizontal and vertical directions cannot be eliminated throughout the screen as shown in FIG. 5.

This is because the electric fields distributed to the center hole and side hole of the main focusing lens are basically different from each other, an additional correction unit is necessarily required.

In addition to this, the molding as well as forming for fabricating the inclined extension electrode 12 become very difficult and exacting, resulting in lower productivity.

Referring to FIG. 6, another technique for improving the above-described problems has been proposed. Here, a correction electrode 17 having horizontal barriers on the upper and lower portions of electron beam passing holes 16*a* is welded to be fixed to a shield cup 16, and in turn, the shield cup 16 having the correction electrode 17 fixed thereto is inserted to the second accelerating and focusing electrode 6.

This technique is advantageous in that the correction electrode 17 sufficiently blocks the magnetic field produced by the deflection yoke when the electron beams emitted from the cathodes pass through the second accelerating and focusing electrode 6, which can correct the astigmatism in a desired direction without affecting the convergence.

In this technique, however, a punching operation is performed to form the electron beam passing hole 16*a* during processing of the shield cup 16 to which the correction electrode 17 is fixed. Therefore, it is difficult to flatten a connection plane (i.e., the surrounding portion of the electron beam passing hole 16*a*) for fixing the correction electrode 17, and match the electron beam passing holes formed in the shield cup 16 and the correction electrode 17. As the result, the welding position of the correction electrode 17 is inaccurate causing a change in the movement path of the electron beam and, furthermore. Impending precise processing for making the upper and lower lengths of the correction electrode 17 be the same, with the result that resolution is degraded.

SUMMARY OF THE INVENTION

The present invention is devised to solve the above-described problems. Accordingly, it is an object of the present invention to provide an electron gun body for a CCRT, wherein an electron beam passing hole is formed as high as a bottom portion formed to a first inclined extension electrode and a projection is formed to both sides of a head portion of a second inclined extension electrode while expanding to a side beam hole, whereby the projection functions as a correction electrode without installing a separate correction electrode to a shield cup.

To achieve the above object of the present invention, there is provided an electron gun body for a color cathode ray tube including an electron beam forming region formed by at least cathodes, a first grid and a second grid, and a main focusing lens having first and second accelerating and focusing electrodes for substantially focusing three electron beams ejected from the electron beam forming region. Here, the first and second accelerating and focusing electrodes are provided with through holes for passing the three electron beams and upper rims respectively inwardly bent from the outer circumferences of the electrodes toward the through holes. Furthermore, a first inclined extension electrode having a vertically-provided sloped portion and bottom portion, and a center hole opened to reach a bent plane of the sloped portion in the bottom portion is installed into the first accelerating and focusing electrode by fixing one side of the first inclined extension electrode to connect with the inwardly-bent portion of the one upper rim. In addition to the first inclined extension electrode, a second inclined extension electrode having projections parallel to each other on the same plane of a head portion is installed into the second accelerating and focusing electrode, with forming the vertical inner distanced of the projection formed to be smaller than that of the other upper rim, to fix one side of the second inclined extension electrode to connect with the inwardly-bent portion of the other upper rim.

BRIEF DESCRIPTION OF THE DRAWINGS

The above objects and other advantages of the present invention will become more apparent by describing in detail preferred embodiments thereof with reference to the attached drawings in which:

FIG. 15 is diagrammatic views showing a state of forming the main focusing lens in accordance with the presence or absence of the first and second inclined extension electrodes, wherein

DETAILED DESCRIPTION OF THE PREFERRED EMBODIMENTS

Figure 1:
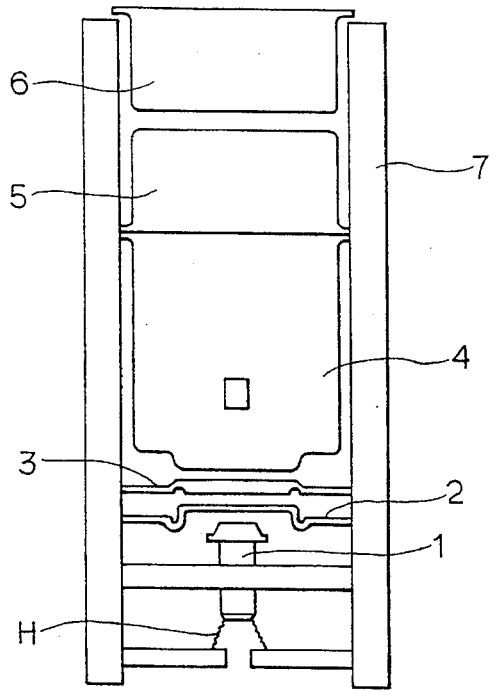
FIG.1 prior art
FIG. 1 is a partially cutaway front view showing a conventional electron gun of a unipolar main electrostatic lens type.
Figure 2:
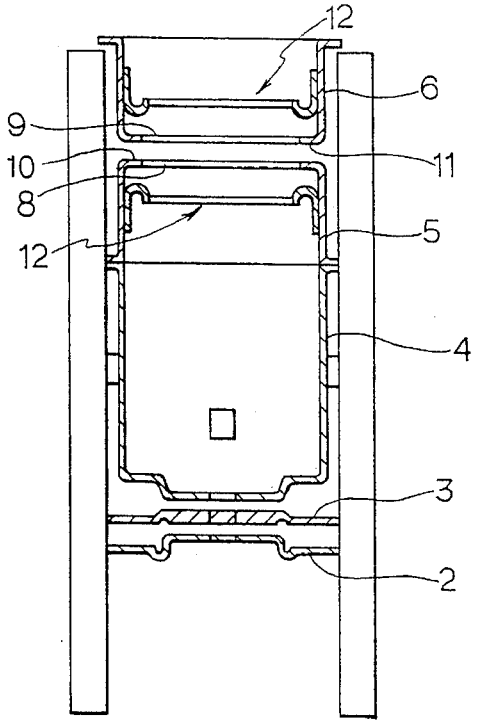
FIG.2 prior art
FIG. 2 is a cross sectional view showing a conventional electron gun installed with an inclined extension electrode.
Figure 3:
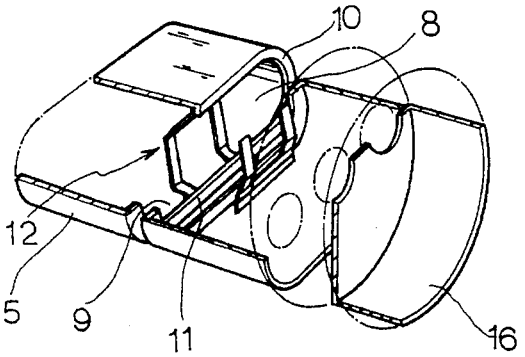
FIG.3 prior art
FIG. 3 is a partially cutaway view in perspective of a principal portion of the electron gun shown in FIG. 2.
Figure 4:
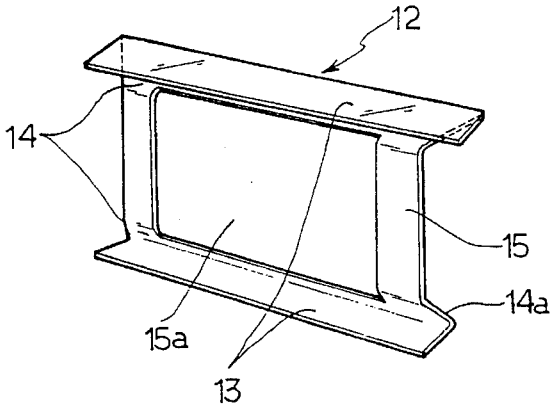
FIG.4 prior art
FIG. 4 is a perspective view showing the conventional inclined extension electrode.
Figure 5:
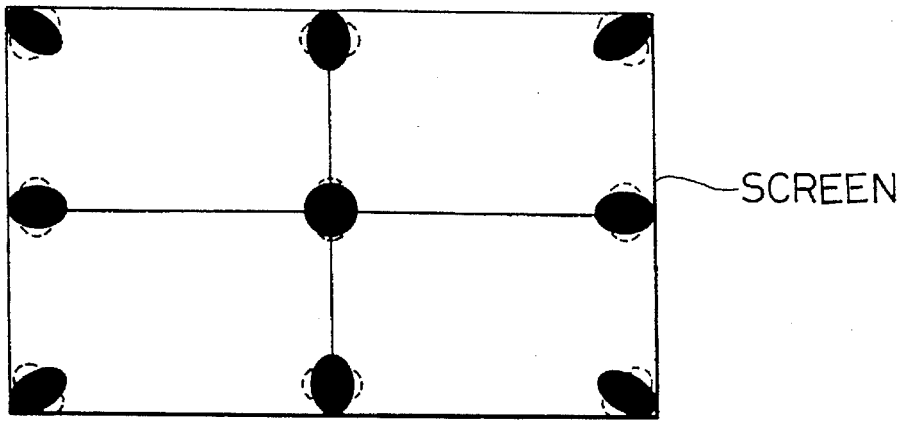
FIG.5 prior art
FIG. 5 is a reference view illustrating the shapes of conventional electron beam spots on respective portions of a screen.
Figure 6:
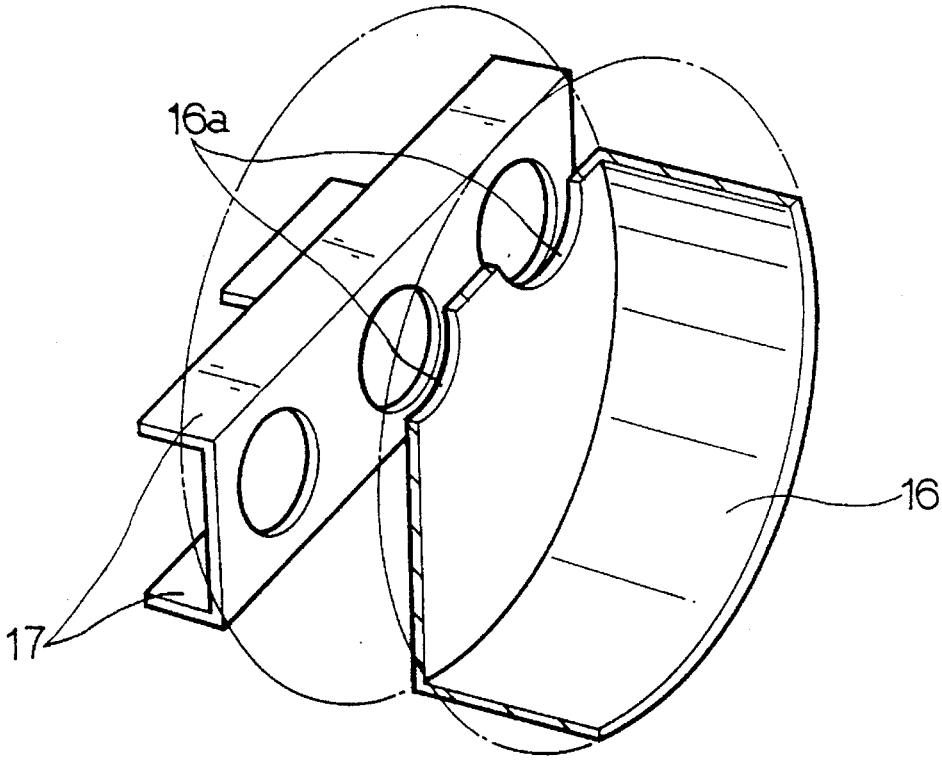
FIG.6 prior art
FIG. 6 is a perspective view showing a state that a correction electrode is fixed to a conventional shield cup.
Figure 7:
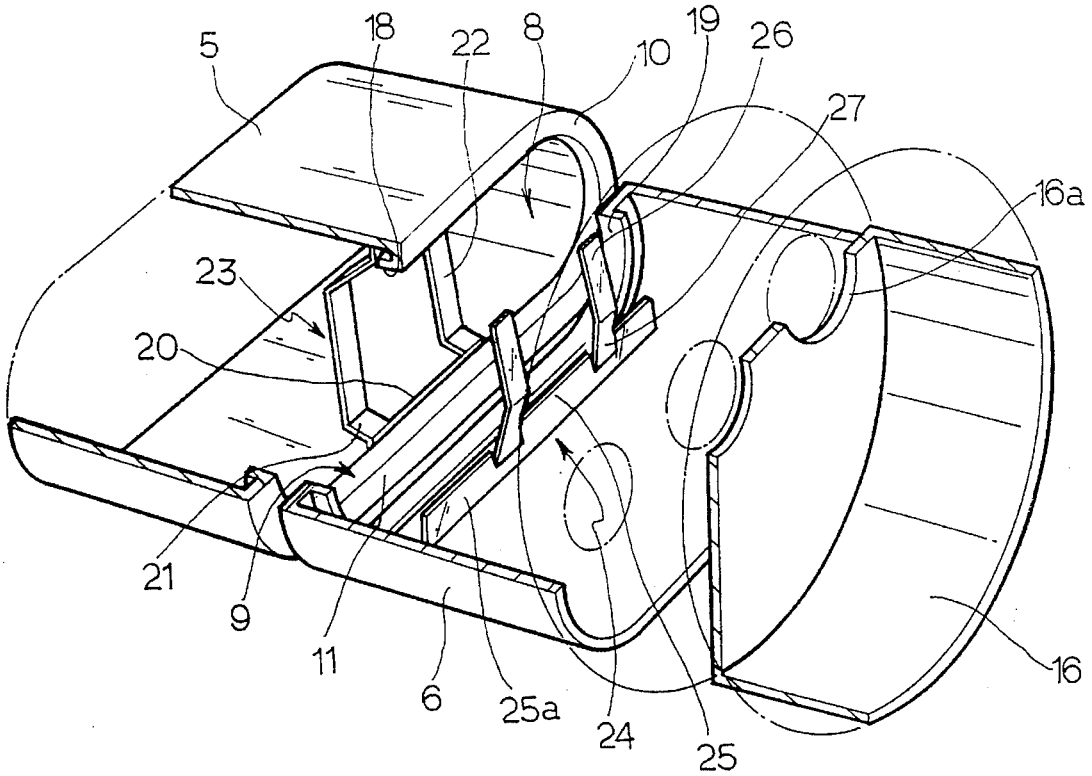
FIG. 7 is a partially cutaway view in perspective of a principal portion of an electron gun to which one embodiment of the present invention is applied.

An electron gun body for a CCRT according to the present invention will be described with reference to FIGS. 7 to 9.

In the present invention, elongated through holes 8 and for allowing for three electron beams are formed in the opposing planes of a first accelerating and focusing electrode and a second accelerating and focusing electrode 6, which face with each other to form a main focusing lens. Upper rims 10 and 11 are formed to be bent from the outer circumferences of the first and second accelerating and focusing electrodes 5 and 6 toward the through holes 8 and 9. Also, inwardly-bent portions 18 and 19 bent to the inner portions of the respective electrodes 5 and 6 are formed at the ends of the upper rims 10 and 11.

Figure 8:
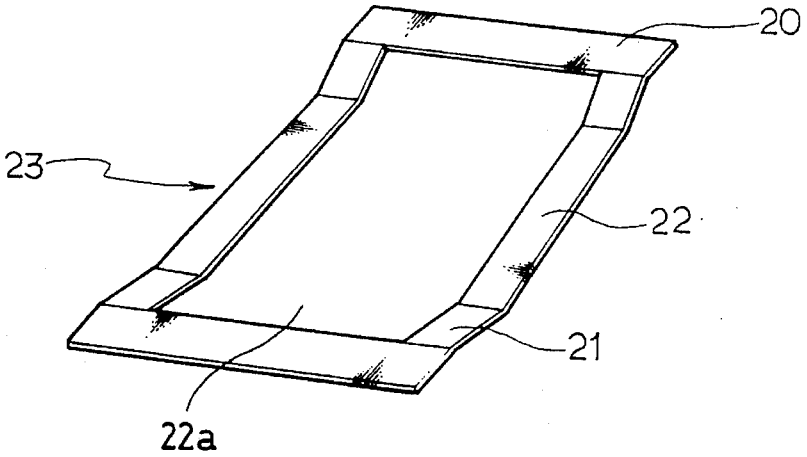
FIG. 8 is a perspective view showing the first inclined extension electrode according to the present invention fixed into the first accelerating and focusing electrode.

As shown in FIG. 8, both sides of a first inclined extension electrode 23 having a head portion 20, a sloped portion 21 and a bottom portion 22 are vertically provided in the first accelerating and focusing electrode 5 (in the vicinity of the through hole 8), and a center hole **22*a* formed in the first inclined extension electrode 23 is provided just to the bent plane of the sloped portion 21 and bottom portion 22. Then, one side of the first inclined extension electrode 23 is fixed to connect with the inwardly-bent portion 18 of the upper rim 10**.

The sloped portion 21 of the first inclined extension electrode 23 serves by smoothly forming an electric field to enlarge the aperture of a main lens.

In other words, the sloped portion 21 decreases spherical aberration to minimize a beam spot size.

The head portion 20 is welded to fix the first inclined extension electrode 23 to the inside the first accelerating and focusing electrode 5.

By this operation, three electron beam passing holes are separately formed in the through hole 8 side of the first accelerating and focusing electrode 5.

Thereafter, a second inclined extension electrode 24 is fixed into a second accelerating and focusing electrode 6 (in the vicinity of the through hole 9).

Figure 9:
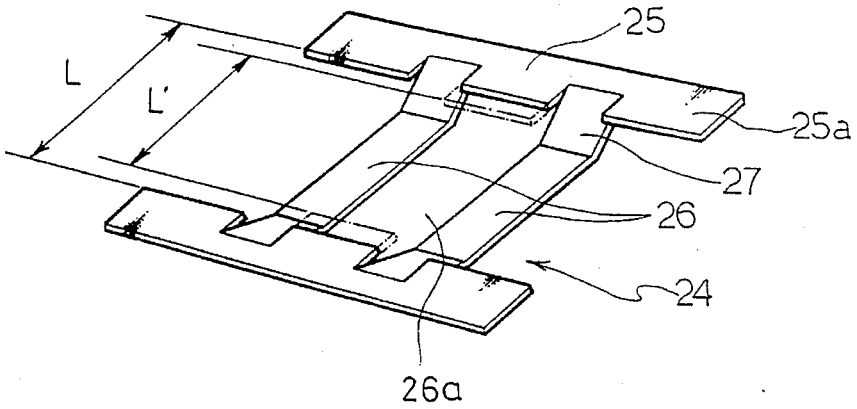
FIG. 9 is a perspective view showing the second inclined extension electrode according to the present invention fixed into the second accelerating and focusing electrode.
Figure 10:
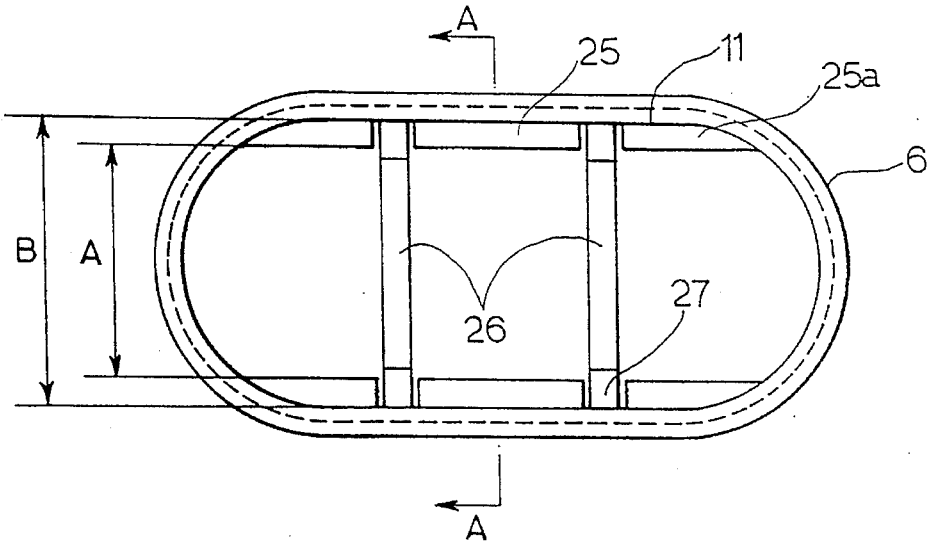
FIG. 10 is a front view showing the second accelerating and focusing electrode having the second inclined extension electrode into according to the present invention fixed thereinto.
Figure 11:
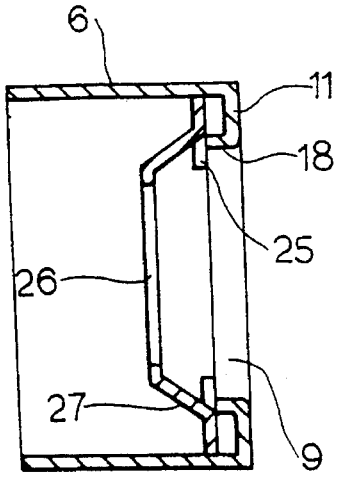
FIG. 11 is a sectional view taken along line A—A of FIG. 10.

According to one embodiment, as shown in FIG. 9, the second inclined extension electrode 24 is constructed such that projections **25*a* are formed parallel to each other in both directions on the same plane of a head portion 25, and a sloped portion 27 extending to the head portion 25 is formed between the head portion 25 and a bottom portion 26. In this structure, a vertical inner distance A of the projection 25*a* is formed to be smaller than that B of the upper rim 11 as shown in FIG. 10**.

The reason of making the vertical inner diameter A of the projection **25*a* smaller than that B of the upper rim 11** is for correcting astigmatism in accordance with the electrode dimensions that satisfy static convergence.

Figure 12:
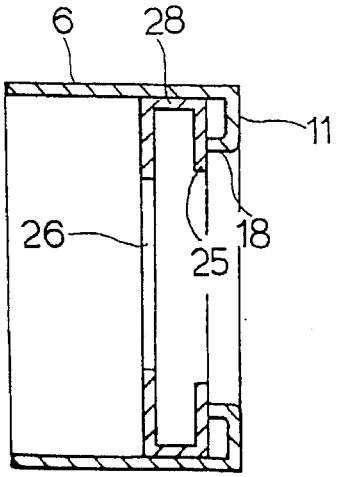
FIG. 12 is a sectional view showing another embodiment of the present invention, taken along line A—A of FIG. 10.

As shown in FIG. 12 which illustrates another embodiment of the second inclined extension electrode 24, however, a connection portion 28 perpendicular to the projection **25*a* may be provided by expanding the sloped portion 27 of the second inclined extension electrode 24** to the inner sidewall of the horizontally-elongated hole.

The second inclined extension electrode 24 having the above structure not only improves the strength of the electrode over that of the second inclined extension electrode of the above one embodiment but also performs the same function.

As designated by the single dotted line of FIG. 9, the projecting amount of the head portion 25 of the second inclined extension electrode 24 protruding to the center hole **26*a* as shown at L' can be greater than of the projection 25*a*** protruding to the side hole as shown at L.

This is for favorably eliminating the astigmatism in the center hole **26*a*** and the side hole.

One side of the second inclined extension electrode 24 having the above structure is fixed into the second accelerating and focusing electrode 6 to connect with the inwardly-bent portion 19 of the upper rim 11.

By this construction, three electron beam passing holes are independently formed to the through hole 9 side of the second accelerating and focusing electrode 6 by the second inclined extension electrode 24.

Hereinafter, the operation and effect of the present invention formed as above will be described in detail.

To begin with, when a power is supplied to a heater H installed within cathodes 1 under the state that the first inclined extension electrode 23 is fixed to connect with the upper rim 10 of the first accelerating and focusing electrode 5 and the second inclined extension electrode 24 is fixed to connect with the upper rim 11 of the second accelerating and focusing electrode 6, three electron beams are focused by the main focusing lens formed between the first and second accelerating and focusing electrodes 5 and 6 while advancing toward a screen.

The electron beams focused by the main focusing lens have the minimized beam spot size by the first inclined extension electrode 23.

Figure 13:
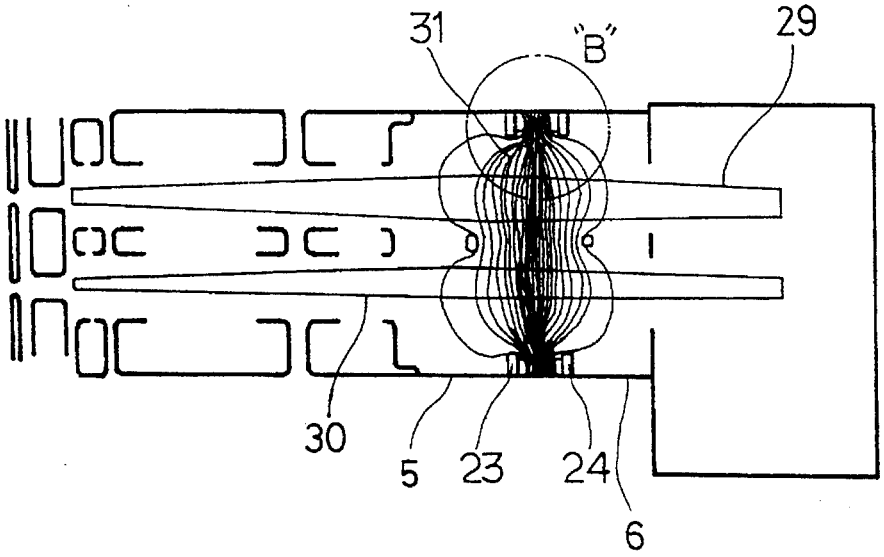
FIG. 13 is a diagrammatic view for illustrating a principle of eliminating the difference of focusing forces in the horizontal and vertical directions by means of the first and second inclined extension electrodes according to the present invention.

In more detail, as shown in FIG. 13, the focusing difference of the main focusing lens 31 between the horizontal direction and vertical direction is eliminated under the state that the side beam 29 and the central beam 30 among three electron beams emitted from the electron gun pass through the main focusing lens 31 formed between the first and second accelerating and focusing electrodes 5 and 6, and coincide in the center of the screen to satisfy the static convergence.

If there is no correction electrode during the above-stated procedure, a phenomenon of over-focusing in the vertical direction appears under the state that the main focusing lens 31 satisfies the static convergence.

However, when the projections 25*a* are formed at both sides of the head portion 25 as in the present invention, the over-focusing of the electron beams in the vertical direction is prevented to inhibit the occurrence of focusing difference in the horizontal and vertical directions.

Figure 14:
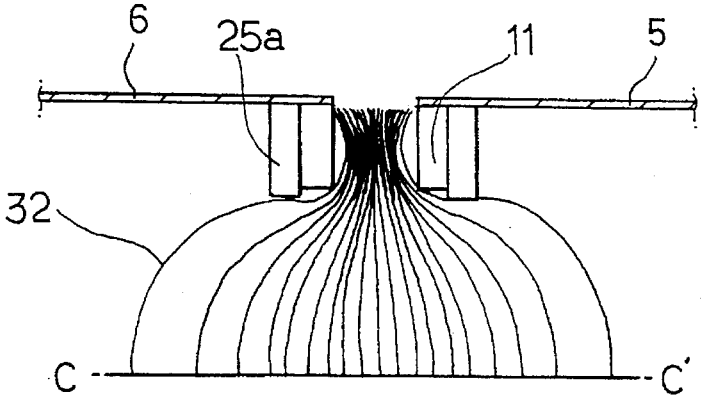
FIG. 14 is an enlargement view showing the portion "B" of FIG. 13.

Referring to FIG. 14, the principle of this effect will be described. Since the head portion 25 and projection 25*a* of the second inclined extension electrode 24 protrude longer than the end of the inner side of the upper rim 11 at the inwardly-bent portion 19 expanding from the inner end of the upper rim 11 of the second accelerating and focusing electrode 6 toward a center axis C–C' perpendicular to the main focusing lens 31, the electron beams passing therethrough much diverge in the vertical direction of the main focusing lens 31 to form a divergence equipotential line 32 to be have a greater bulge.

Figure 15A:
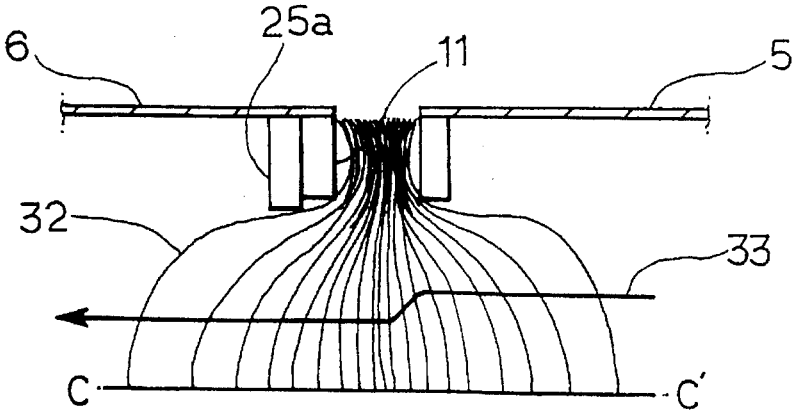
FIG. 15A is a diagrammatic view showing the state that the first and second inclined extension electrodes are installed.
Figure 15B:
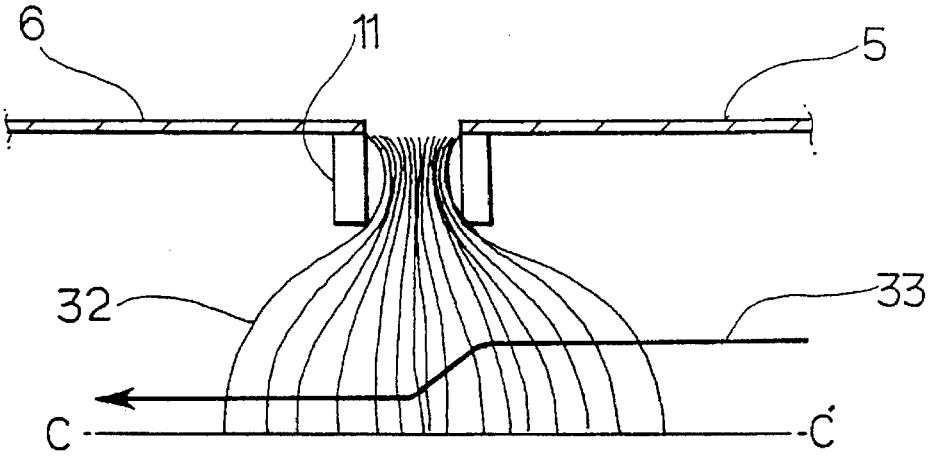
FIG. 15B is a diagrammatic view showing the state that the first and second inclined extension electrodes are not installed.

FIGS. 15A and 15B diagrammatically illustrate phenomena that the electron beams are passed through the main focusing lens with or without the projection 25*a* of the second inclined extension electrode 24.

Figure 16:
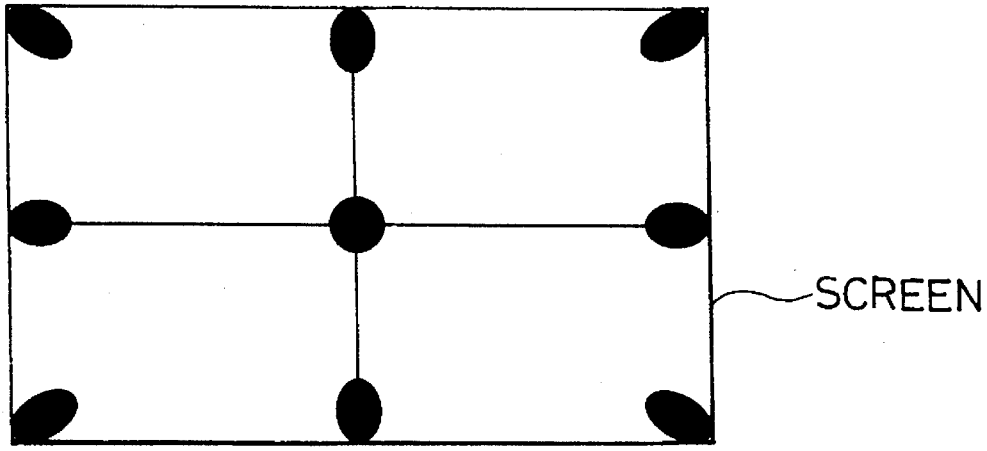
FIG. 16 is a reference view illustrating the shapes of electron beam spots according to the present invention on respective portions of a screen.

As described above, the main focusing lens 31 (FIG. 15A) having the projection 25*a* of the second inclined extension electrode 24 formed within the second accelerating and focusing electrode 6 increases the diverging force in the vertical direction to gradually focus the electron beam 33 when passing through the main focusing lens 31. Therefore, the focusing difference from the horizontal direction is eliminated to obtain the small and highly-dense electron beam spot in both the center and periphery of the screen as shown in FIG. 16.

On the contrary, the main focusing lens (FIG. 15B) without the projection reinforces the focusing force in the vertical direction to over-focus the electron beam 33 toward the center axis C–C'. Therefore, it can be noted that halo phenomenon occurs in the center as well as periphery of the screen.

Furthermore, as shown in the another embodiment of FIG. 12, when the sloped portion 27 of the second inclined extension electrode 24 expands toward the inner portion of the second accelerating and focusing electrode 6 to provide the connection portion being perpendicular to the projection 25*a*, the same operation as the above is carried out to obtain the small and highly-dense electron beam spot in both the center and periphery of the screen. Moreover, the connection portion 28 serves for reinforcing the strength of the second inclined extension electrode 24.

As described above, an electron gun body for a CCRT according to the present invention eliminates the astigmatism which is the difference between the horizontal focusing force and vertical focusing force of the electron beams without separately installing a correction electrode within first and second accelerating and focusing electrodes, so that the deteriorated phenomenon of the focusing characteristic is improved and the distance between electron beams is shortened with the consequence of minimizing the deflection aberration due to a deflection yoke.

As a result, an electron gun body for a CCRT requiring favorable convergence characteristics of respective electron beams can shorten the distance between respective electron beams while effectively enlarging the aperture of a main focusing lens.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. An electron gun body for a color cathode ray tube including an electron beam forming region formed by at least cathodes, a first grid and a second grid, and a main focusing lens having first and second accelerating and focusing electrodes for substantially focusing three electron beams ejected from said electron beam forming region, said first and second accelerating and focusing electrodes being provided with through holes for passing said three electron beams and upper rims respectively inwardly-bent from the outer circumferences of said electrodes toward said through holes, wherein a first inclined extension electrode having a vertically-provided sloped portion and bottom portion installed into the first accelerating and focusing electrode, wherein one side of the first inclined extension electrode connected with the inwardly-bent portion of a first upper rim of the first electrode, and a center hole provided to a bent plane of said sloped portion and said bottom portion; and a second inclined extension electrode having projections parallel to each other on the same plane of a head portion installed into said second accelerating and focusing electrode, wherein the vertical inner distance of a projection is smaller than that of a second upper rim of said second accelerating and focusing electrode, with one side of said second inclined extension electrode connected with the inwardly-bent portion of said second upper rim of said second accelerating and focusing electrode.

2. An electron gun body for a color cathode ray tube as claimed in claim 1, wherein said sloped portion of a second inclined extension electrode fixed to said second accelerating and focusing electrode expands toward a sidewall of the inner distance of said second accelerating and focusing electrode with a connection portion perpendicular to said projection.

3. An electron gun body for a color cathode ray tube as claimed in claim 2, wherein the projecting amount of said projection of said second inclined extension electrode installed in said second accelerating and focusing electrode is greater than that of said head portions thereof.

4. An electron gun body for a color cathode ray tube as claimed in claim 1, wherein the projecting amount of said projections of said second inclined extension electrode installed in said second accelerating and focusing electrode is greater than that of said head portions thereof.

* * * * *